US006882289B2

(12) United States Patent
Motsenbocker

(10) Patent No.: US 6,882,289 B2
(45) Date of Patent: Apr. 19, 2005

(54) MONITORING AND CONTROL OF WATERCRAFT PROPULSION EFFICIENCY

(76) Inventor: Marvin A. Motsenbocker, 17 Wallace Farms La., Fredericksburg, VA (US) 22406

( * ) Notice: Subject to any disclaimer, the term of this patent is extended or adjusted under 35 U.S.C. 154(b) by 94 days.

(21) Appl. No.: 10/164,567

(22) Filed: Jun. 10, 2002

(65) Prior Publication Data

US 2002/0185046 A1 Dec. 12, 2002

Related U.S. Application Data

(60) Provisional application No. 60/296,754, filed on Jun. 11, 2001.

(51) Int. Cl.[7] ..... G08B 23/00

(52) U.S. Cl. ..... 340/984; 340/995.27; 340/979; 440/49; 440/63; 440/76

(58) Field of Search ..... 340/984, 986, 340/987, 995.27, 995.28, 978, 979, 969; 440/49, 66, 70, 63, 2, 76, 78

(56) References Cited

U.S. PATENT DOCUMENTS

| | | | | |
|---|---|---|---|---|
| 2,769,420 A | | 11/1956 | Horton et al. | |
| 4,188,906 A | | 2/1980 | Tachmindji et al. | |
| 4,293,280 A | | 10/1981 | Yim | |
| 5,030,149 A | | 7/1991 | Fujita | |
| 5,083,950 A | | 1/1992 | Suhrbier | |
| 5,190,487 A | * | 3/1993 | Fukui | 440/1 |
| 5,209,642 A | | 5/1993 | Larimer et al. | |
| 5,405,276 A | | 4/1995 | Kato | |
| 5,456,200 A | | 10/1995 | Shen | |
| 5,588,886 A | * | 12/1996 | Davis | 440/67 |
| 5,613,887 A | * | 3/1997 | Kobayashi | 440/47 |
| 5,711,742 A | * | 1/1998 | Leinonen et al. | 477/121 |
| 5,800,224 A | | 9/1998 | Ogino | |
| 5,807,151 A | * | 9/1998 | Sumino | 440/80 |
| 5,833,501 A | * | 11/1998 | Jones | 440/47 |
| 5,941,188 A | * | 8/1999 | Takashima | 440/84 |
| 6,227,918 B1 | * | 5/2001 | Wharton | 440/2 |

* cited by examiner

*Primary Examiner*—Jeffery Hofsass
*Assistant Examiner*—Daniel Previl

(57) ABSTRACT

Readout devices and controls are provided that alert the user to unusual propeller slip conditions. Embodiments of the invention incorporate some signal processing to account for a progressively greater slip at lower watercraft speeds. Thus, the invention provides simple information that tells the user if a boat propeller combination is being operated suboptimally, without requiring the knowledge and use of multiple slip figures for differing boat speeds. The invention allows greater economy of operation, automatic anticavitation control and can alert the watercraft operator to unusual conditions such as anchor down, propeller up other situations that affect propeller loading.

26 Claims, 5 Drawing Sheets

MONITORING AND CONTROL OF WATERCRAFT PROPULSION EFFICIENCY

REFERENCE TO RELATED APPLICATIONS

This application claims benefit from application No. 60/296,754, filed Jun. 11, 2001.

BACKGROUND OF THE INVENTION

Electric motors increasingly are being used in watercraft because of their greater efficiencies compared to fossil fueled motors. Other advantages prompting use of electric motors include smaller weight, greater reliability and elimination of smoke and fumes when using an electric motor, particularly in combination with all electric battery systems. Typically, a source of electric power, such as a lead acid battery bank or fuel cell, is connected to the electric motor and an electronic valve such as a PMW (pulse modulated width) controller is used to modulate motor power. The motor output is coupled to a propeller either directly through a shaft coupling, or indirectly, through a belt, gear or other mechanism. In practice, a boat operator increases boat speed merely by increasing motor power. To slow down, the operator decreases motor power and/or drives the propeller in the reverse direction. Such simple control systems are used particularly for slow watercraft that are limited to a calculable hull speed above characteristic of a displacement vessel.

Unfortunately, merely increasing power to a propeller does not automatically translate proportionally into increased speed. Accordingly the actual selection of motor power affects overall efficiency, as reviewed here. A spinning propeller will push water with different efficiencies depending on a number of factors. Among these factors are the pitch of the propeller and the speed of the boat. A propeller's pitch usually is expressed as a distance that the propeller edge moves forward in a single revolution. By multiplying the pitch by rpm (revolutions per minute) the distance that an ideal propeller (assuming no friction) can move in one minute is determined.

In the real world a propeller does not move water at the ideal rate but will experience some slip. The slip can be calculated as an "apparent slip" as for example described by David Gerr who points out that water is "a fluid and so a propeller slips or slides a bit as it rotates. It's more exact to view slip as the difference between the distance a boat actually travels through the water—in the time of one complete propeller revolution at her speed through the water, V—and the theoretical distance it would travel if it advanced the full pitch of the propeller. This difference is called 'apparent slip' (SlipA) and is expressed as a percent of theoretical propeller advance (pitch times RPM)" (Propeller Handbook p. 48 McGraw-Hill Companies 1989). The term "slip" as used herein means the "apparent slip" defined by Mr. Gerr.

Some propeller slip is necessary for a propeller to accelerate a boat and represents inefficiency in moving the boat. The inefficiency of the drive system at different speeds is not obvious to the user and for the most part is not appreciated unless the user actually see or hears the wasted energy from extreme positive slip as cavitation. Cavitation is an extreme case of propeller slip where so much power is applied to the propeller that the propeller turns rapidly without significantly moving water. During cavitation, much of the propeller energy is lost in the formation of bubbles and some is lost as heat. Cavitation has been a concern of boaters that use internal combustion engines because of the tremendous energy used to achieve and maintain high-speed conditions, and the ease which cavitation can occur under those circumstances.

The cavitation problem has been recognized as a condition of drive system inefficiency and has been recognized for many years. Other inventors have addressed cavitation by discovering new propeller designs and materials (U.S. Pat. Nos. 4,293,280; 4,188,906 5,800,224; 5,711,742; 5,456,200; 5,209,642; 5,083,950; 5,405,276; 2,769,420 and 5,030,149 for example) that withstand the destructive energy from bubble forming and breaking at the propeller surfaces.

More recently, attempts have been made to detect or prevent cavitation of internal engine driven propellers by monitoring water pressure near the propeller and using a water pressure signal to feedback interruption of a spark to the engine. U.S. Pat. No. 5,613,887 describes the placement of one or more pressure sensors that create a mechanical signal that is conducted through a vacuum line and then converted into an electrical signal to indicate pressure. U.S. Pat. No. 5,190,487 uses a bubble detector to detect conditions that precede cavitation. The bubble detector output signal is compared with other signals to output an engine slowdown signal that decreases speed of the internal combustion engine. Another pressure sensor system used to limit combustion of fuel is shown in U.S. Pat. No. 5,833,501, which is designed to prevent cavitation and which emphasizes that this problem is higher "in watercraft having more powerful engines."

Although each of the patents cited above addresses cavitation in internal combustion engine drive watercraft the general problem of overall efficiency at different propeller speeds and different boat speeds remains under recognized. Furthermore, known systems for alleviating or preventing cavitation in fossil fueled boats are crude and generally merely detect gross cavitation, or caviation-onset conditions but do not specifically detect propeller slippage itself over a wide range. Still further, the systems are designed around fossil fuel burning engines and do not respond instantaneously. Yet further, systems used until now generally rely on pressure sensors or other mechanical detecting devices that are prone to reliability problems and false signal problems inherent to mechanical detecting (pressure, bubbles) systems. Accordingly, these systems do not handle properly the more subtle problems of propeller efficiency, particularly from low power, low speed electric motor driven watercraft. Furthermore, future development of fuel cell powered electric boats of higher speed will present more demands on efficiency and improved control. Thus, much more needs to be done, both for slow moving displacement electric powered watercraft and for faster fuel cell powered watercraft, as well as fossil fuel powered watercraft.

SUMMARY OF THE INVENTION

The invention is aimed at overcoming the above problems in watercraft.

One object of the invention is to provide a continuous optical readout in real time of propeller slip over a wide range of boat speeds. This readout allows the boat operator to optimize electric motor power for more efficient travel even at low speeds where cavitation is not a major concern.

Another object of the invention is to alert the boat operator to an adverse condition such as low speed cavitation, high (near hull displacement speed) cavitation, high planing or semi planing speed cavitation, excessive loading, fouled propeller and the like.

Yet another object of the invention is to provide autonomic control by setting a given desirable speed adjust motor power to obtain an efficient acceleration rate, adjusting motor power to obtain a desired cruising speed, adjusting motor power to decrease cavitation and the like.

In another embodiment propeller slip is expressed on a continuous scale via an analog meter having two or more regions indicating acceptable slip and unacceptable slip. In a preferred embodiment the analog meter display face contains areas, from left to right showing deceleration conditions (typically blue, black or white colored), acceptable economy acceleration (typically green colored), higher acceleration (typically yellow colored) and excess slippage (typically red colored). Another embodiment utilizes at least two light emitting diodes to display acceptable acceleration slip (typically green colored) and excess slippage (typically red colored). In another embodiment a series of light emitting diodes are arranged to display at least three conditions. In yet another embodiment a single light emitting diode is used to indicate excess slippage, and yet another embodiment a buzzer or other audible warning device is used to indicate excess slippage. In each embodiment an audible alerting device, such as a piezoelectric horn preferably is used to indicate gross excess slippage indicating cavitation.

Another object of the invention is to detect low speed cavitation separately from high speed cavitation or excess slippage that occurs at or near the boat hull speed. One embodiment pursuant thereto is an electric boat propeller efficiency indicator comprising an analog meter having a display surface with at least two visual indicator areas that indicate desirable slip and excessive slip, wherein the indicator areas are located at the left side and right sides, respectively. Another embodiment is a readout system for continuously reporting electric boat propeller efficiency in a displacement hull vessel, comprising: (a) a transducer or other device that outputs an electrical signal proportional to propeller speed; (b) a means for generating an electrical signal proportional to boat speed; (c) a signal generating unit that outputs a visual and/or auditory signal indicating propeller efficiency.

Another embodiment of the invention is a visual display system for continuously indicating electric motor driven boat propeller efficiency comprising: a) a propeller rotational speed electrical input; b) a comparison signal electrical input; and c) a visual indicator, wherein the signal input of (b) is compared with the propeller speed signal input of (a) to generate a continuous output analog or digital signal used by the visual indicator to continuously indicate propeller efficiency.

Another embodiment is a visual indicator of electric boat propeller efficiency comprising: a) a transducer that generates an electrical signal proportional to propeller rpm; b) a transducer or other device that generates an electrical signal proportional to boat speed; c) a comparator that compares the signal of a) with the signal of b) to output a comparison signal indicating relative propeller slip; and d) a visual output indicator that indicates relative slip.

Another embodiment is a cavitation indication device for an electric motor driven watercraft comprising: a) a transducer for generating an electrical signal proportional to propeller rpm; b) an electrical comparison signal proportional to motor power, motor current, and/or boat speed; and c) a visual or audible readout signaler that indicates the presence of low speed cavitation during acceleration and high speed cavitation near displacement hull speed.

Yet another embodiment is a cavitation indicator for a displacement electric motor driven watercraft, the indicator capable of detecting acceleration cavitation separate from cavitation occuring near hull speed, comprising: a) a transducer for generating an electrical signal proportional to propeller rpm; b) a reference electric signal that is proportional to motor power, motor current and/or boat speed; c) a comparator that receives signals from a) and b) wherein the comparator uses the signals from a) and b) to detect low speed acceleration cavitation, no cavitation and high hull speed limiting cavitation conditions; and d) an output device.

Yet another embodiment is a device for alleviating cavitation of an electric motor driven watercraft comprising: a) a transducer for generating an electrical signal proportional to propeller rpm; b) a reference electric signal that is proportional to motor power, motor current and/or boat speed; c) a comparator that receives signals from a) and b) and outputs a cavitation detection signal upon detecting cavitation; and d) an electronic controller for adjusting motor power and/or rpm upon generation of the cavitation detection signal.

Yet another embodiment is A visual display for continuously indicating motor driven boat propeller efficiency comprising: a first electrical signal proportional to boat speed; a second electrical signal proportional to propeller speed; a circuit that accepts the first electrical signal proportional to boat speed and the second electrical signal proportional to propeller speed and compares the two signals to generate a slip measurement that is output; and a signal display that accepts the output measurement selected from the group consisting of an analog meter with a display surface having at least two colored areas denoting acceptable efficiency and less optimum efficiency; an analog meter with a display surface having green, yellow and red lights or colored areas that respectively indicate acceptable, less acceptable and least acceptable efficiency, an analog meter having a display surface with at least 3 regions located from left to right as indicating negative slip (deceleration), acceptable slip and excessive slip (or cavitation) respectively respectively; a display surface having multiple light emitting diodes denoting at least an acceptable efficiency and a less acceptable efficiency; and a liquid crystal display, wherein a greater acceptable slip at lower speed is factored into the comparison by the circuit of or is accommodated by the display to indicate acceptable slip Yet another embodiment is a device that can detect an anchor down or propeller up situation or another unusual loading condition for a propeller comprising: a) a transducer for generating an electrical signal proportional to propeller rpm; b) a reference electric signal that is proportional to motor power, motor current and/or boat speed; c) a comparator that receives signals from a) and b) and outputs an anomalous propeller loading signal upon detecting a high slip condition at low propeller speed and low boat speed; and d) a signaling device that audibly and/or visually alerts the boat operator upon detecting a propeller down situation.

DESCRIPTION OF THE FIGURES

FIG. 4*a* shows a multiple light emitting diode block meter with 10 different segments. FIG. 4*b* shows a multiple light emitting diode meter with 8 segments arranged in a partial circle to simulate an analog device. FIG. 4*c* shows a design that provides more meaningful information in the form of a slope.

DETAILED DESCRIPTION OF THE INVENTION

While working with and evaluating the advantages of electronic control systems for electric motor driven boats, the inventors studied a poorly appreciated problem in the art related to propeller slip, and during those studies made several insights and discoveries. One insight was that although some propeller slip is necessary for acceleration, inefficiencies can be seen as various degrees of propeller slip that differ from desired slip values. Furthermore, if slip is measured in real time at different speeds the boat operator can learn more about the boat propulsion efficiency and other conditions of the boat that affect efficiency. Still further, a slip measurement can be compared with reference or desired value(s) and the comparison results used in real time to adjust the boat motor for improved motor and/or battery and/or fuel cell performance.

Figure 1:
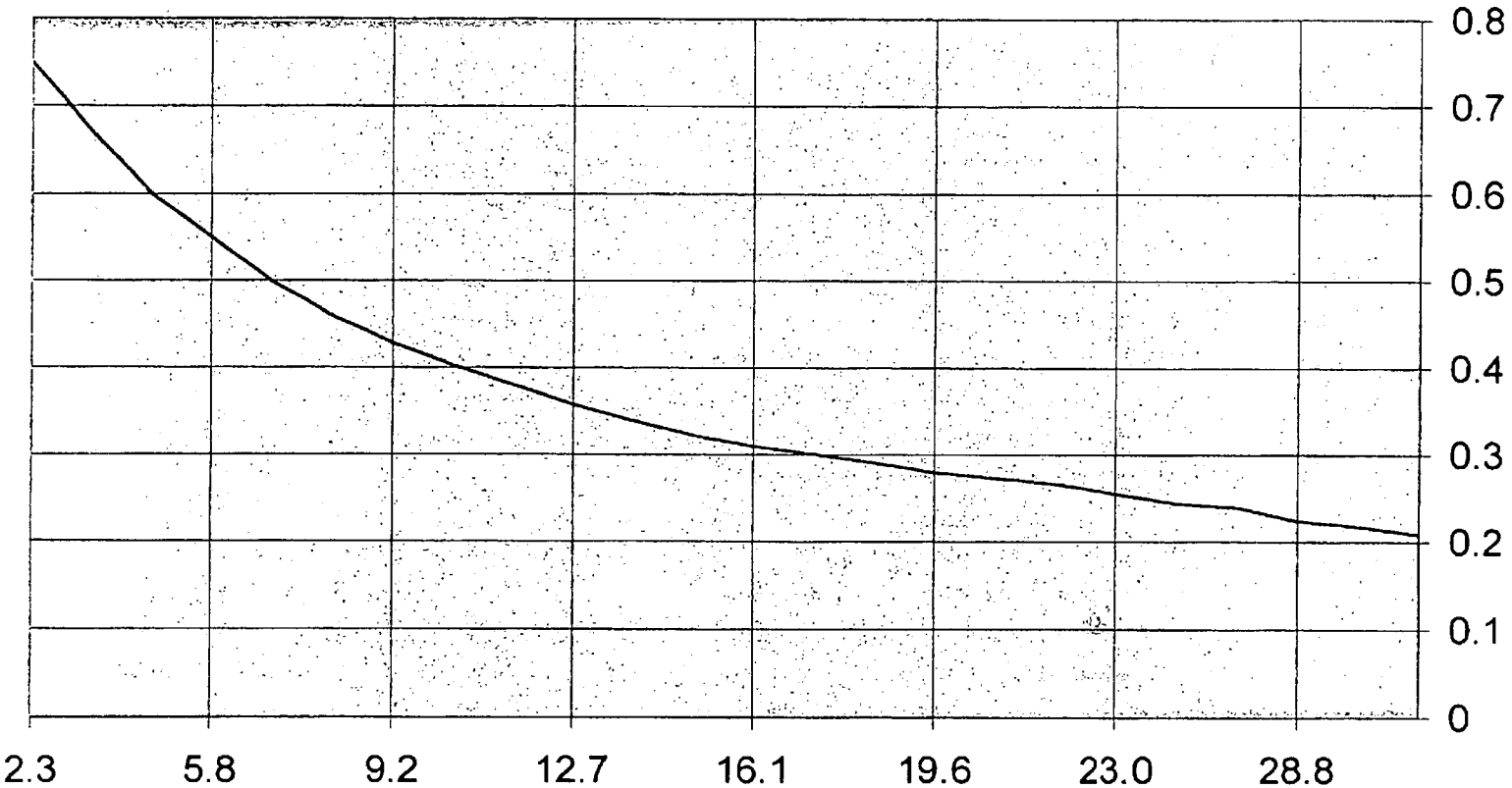
FIG. 1 shows a representative propeller slip versus boat speed curve for a range of watercraft speeds.

FIG. 1 shows a general relationship between ideal slip and boat speed and illustrates how the amount of desirable slip varies downwards with increasing boat speed. The inventor discovered that for any given boat and propeller combination, a similar relationship for ideal slip could be determined empirically and used by a boat manufacturer or the boat operator as a guide for improved performance. The relationship between desired slip and boat speed can be expressed as, for example, a look up table, chart, algorithm, one or more electric voltage resistance or current limits, or electronic circuit parameters. This allows an instantaneous readout of slip to inform the boat user of the boat status at any given time with respect to a given speed, as exemplified in FIG. 1. In one embodiment accordingly, a continuous readout slip measurement device is calibrated to show when slip is excessive (inefficient acceleration for example) close to negative (no acceleration) or very excessive (indicating cavitation).

Unfortunately, however, raw slip numbers generally are not that helpful to regular watercraft operators because the desired slip does not stay constant but changes (generally decreasing) with boat speed. Thus, until now, there has been no satisfactory and widely acceptable slip meter of any kind useful for regular non-technically minded watercraft operators. Embodiments of the invention generate slip signals and massage those signals, either numerically, electrically, by design of analog display gauge region size and/or a combination of each, to accommodate the need for a simple meaningful signal. By way of example, a slip of 1.0 at very low (2 mph) speed generally is acceptable and desired, whereas the same slip at 20 mph in many instances is unacceptably high. Merely reporting this figure as digits on a panel is not helpful to many watercraft operators. A circuit (hardware, microprocessor or both) needs to correspondingly decrease the readout slip signal at low boat speed and/or increase the slip signal at higher boat speed. FIG. 1 shows one set of data indicating acceptable slip. Each boat/motor/propeller will have its own ideal relationship which can be provided by a manufacturer or generated by a user as a calibration for his equipment.

A microprocessor can create or receive a boat speed-slip relationship as a look up table or algorithm. Electrical signals corresponding to boat speed and propeller speed then are compared and the result offset by the table information to generate a more usable signal that may be displayed on an analog meter to the boat operator. This way, meaningful qualitative information is presented to the watercraft operator.

Corresponding signal corrections to prevent overemphasis of measured high slip at lower boat speeds may be made by electronic massaging, or even on a display itself In the latter case a display may have additional markings that distinguish a high speed performance slip from low speed performance slip. Preferably however, conversion from completely quantitative information to qualitative information is carried out by a microprocessor or electronic circuitry that decreases low speed displayed slip with respect to high speed displayed slip. A theme in this embodiment of the invention is that the watercraft operator does not want to play around with numbers and memorize acceptable slip values for different boat speeds. Instead, a panel display, which preferably is an analog gauge, quickly provides the compensated qualitative information. Embodiments of the invention were discovered that convert the otherwise raw or digital numbers into a form suitable for mass consumption by the common pleasure boater.

Of course, for efficient acceleration, the propeller should slip a little more than that needed to maintain a constant speed and, in many cases above the curve shown in FIG. 1. For example, at 5 knots a slip between 0.55 and 0.75 may be used, at 20 knots, a slip between 0.25 and 0.5 may be used. Conversely, a propeller that slows a boat will have negative slip. A propeller having no real effect on boat movement has zero slip. Knowing the relationship between an ideal slip and boat speed can allow manual and/or automated adjustment of propeller power to bring the propeller slip into a more efficient range. Such adjustment would yield many benefits, including finding and using more efficient acceleration conditions, more efficient battery usage, more efficient stopping (allowing optimal regeneration) more efficient cruising, control of cavitation while accelerating at low speed, control of cavitation at or near hull displacement speed and so on.

An extreme positive slip occurs when the propeller turns so fast that it loses much efficiency and makes bubbles. In the case of fossil fueled internal combustion watercraft, such cavitation often is detected by the noise of the motor winding out and/or the bubbles formed by the propeller. Attempts have been made to limit or prevent such cavitation, using mechanical detecting and/or mechanical control systems. However such crude attempts generally have long feedback loop times and cannot easily control motor speed in a virtually instantaneous manner.

The inventors discovered that their all-electronic control systems could provide virtually instantaneous electric motor control to more quickly and efficiently control cavitation, compared with prior art mechanisms and systems. This allows rapid cavitation control during and after onset of cavitation and allows different responses to different cavitations. For example, cavitation at low speeds can be responded to by bringing the motor power within an acceptable acceleration range. Cavitation at high speeds such as cavitation near the hull speed for a displacement boat can be alleviated by lowering motor speed to allow a desired cruising speed that typically is a large fraction of a maximum speed. For example by limiting power until 80%, 90%, or about 95% of hull speed is reached. The prior art cavitation control systems do not address adequately the larger issue of monitoring and controlling slip to improve performance over a range of boat speed conditions.

The electronic control system provides a number of other benefits in terms of increased efficiency. By displaying and/or automatically controlling boat slip a more optimum power can be set for greater efficiency. In another embodiment a circuit that outputs a signal proportional to negative slip (indicating deceleration) controls a motor circuit for optimum regeneration efficiency. This latter embodiment is particularly useful where the field current (magnetic field around the armature) is adjusted to obtain optimum regeneration. For example the field of a separately excited motor is controlled to recover energy from slowing by increasing the field current enough to slow the propeller rotation to achieve an optimum negative slip that gives good regeneration efficiency. If the field is too strong then the propeller will have too much negative slip (eg. water rushes past the propeller without turning it). If the field is too weak the propeller may spin too easily and not absorb as much energy. Of course, the slip signal may be used instead to control the armature circuit of a brushed motor. In each case a routine calibration test may be used to determine what negative slip is preferred for best regeneration efficiency and how to control the motor to obtain desirable resistance to rotation.

Measurement and Display of Slip

Determination of a desired slip during boat travel is made by continuously measuring two or more parameters in real time. Preferably a first parameter is motor rpm, which is measured as a relative propeller rpm electrical signal. Preferably a second parameter is boat speed, which is measured as a relative boat speed electrical signal. These two signals are compared to generate a comparison signal that is proportional to slip. The comparison signal can alert or inform the boat operator, via for example an analog meter, light or buzzer. The signal also may automatically control motor power, via for example adjusting the power to within an acceptable slip range for efficient acceleration, when desired, or by decreasing power, if cavitation or another undesireable high slip condition exists or by controlling magnetism of the motor for desired regeneration suitable for stopping. Where the slip signal is used for control the signal is compared with a known reference value or range of values to generate a pulse or other signal for motor control.

Many different types of sensors may be used as means to generate a boat speed signal. Generally, the transducer creates an electrical signal proportional to boat speed. One or more electrical circuits preferably manipulate the signal before electrical comparison with the propeller signal. Preferred sensors include hall effect transducers or optical sensors on drive shafts coupled to common building block components like digital to analog converters and frequency to voltage converters. These components convert the pulsed signal from the sensor to a proportional voltage or current. In more complex embodiments boat speed signals can be derived from a sonar system or derived from a GPS receiver. In the latter case an NEMA 183 interface may be used as this is compatible with the common computer serial port and can receive boat speed information. A particularly desirable device for generating a boat speed signal, particularly for use in detecting gross slippage such as cavitation, is a piezoelectric mounted on the hull below the waterline, and preferably in the front of the boat. Preferably the device is a metallized piezo film, which is built thin, flexible, is robust and inert, is broadband with a low Q, but having a high piezo activity of, for example, d10 to d100 and more typically d20 to d50. An inexpensive and robust detector made from a piezo film such as that available from Measurement Specialities, (Valley Forge, Pa. USA, website: HYPERLINK http://www.msiusa.com) www.msiusa.com) can provide boat speed information. Use of a piezoelectric detector in this way is a preferred means for obtaining boat speed.

Many different types of sensors also may be used to generate a propeller speed signal. The propeller speed signal is proportional to propeller rpm. This signal also preferably is manipulated electrically before the comparison. Preferably, for internal combustion engine watercraft the propeller speed signal is generated by a tachometer device, as is well known to a skilled artisan. Many electrical motors contain built-in tachometers or have provisions for adding one. In a preferred embodiment a hall effect magnetic sensor is attached to the motor drive or propeller shaft and the pulsing signal is converted into a form that is more easily compared to the boat speed signal.

In a most preferred embodiment that is particularly appropriate for electric boats, NO propeller speed or motor shaft speed sensor is used. Instead, the voltage to the motor is used to infer propeller speed. The inventors discovered that many if not most electric motor driven watercraft are particularly well suited for this low cost and very reliable embodiment. In this embodiment the motor voltage is directly used and is linearly proportional to speed.

Figure 2:
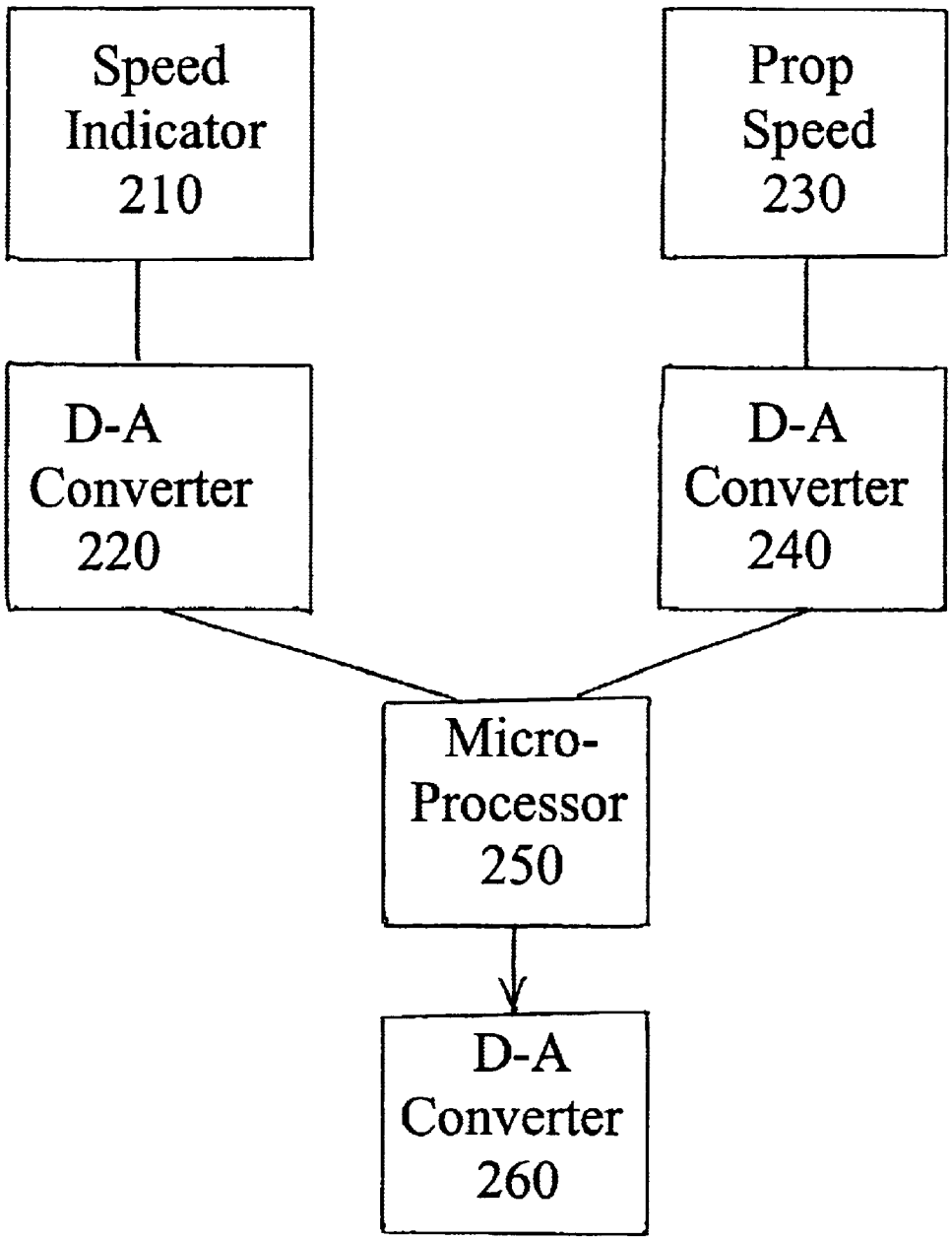
FIG. 2 is a block diagram of an embodiment of the invention that shows a simple circuit for an efficiency meter that compares a propeller speed signal with a boat speed signal and outputs a signal starting at zero level indicative of positive slip.
Figure 3:
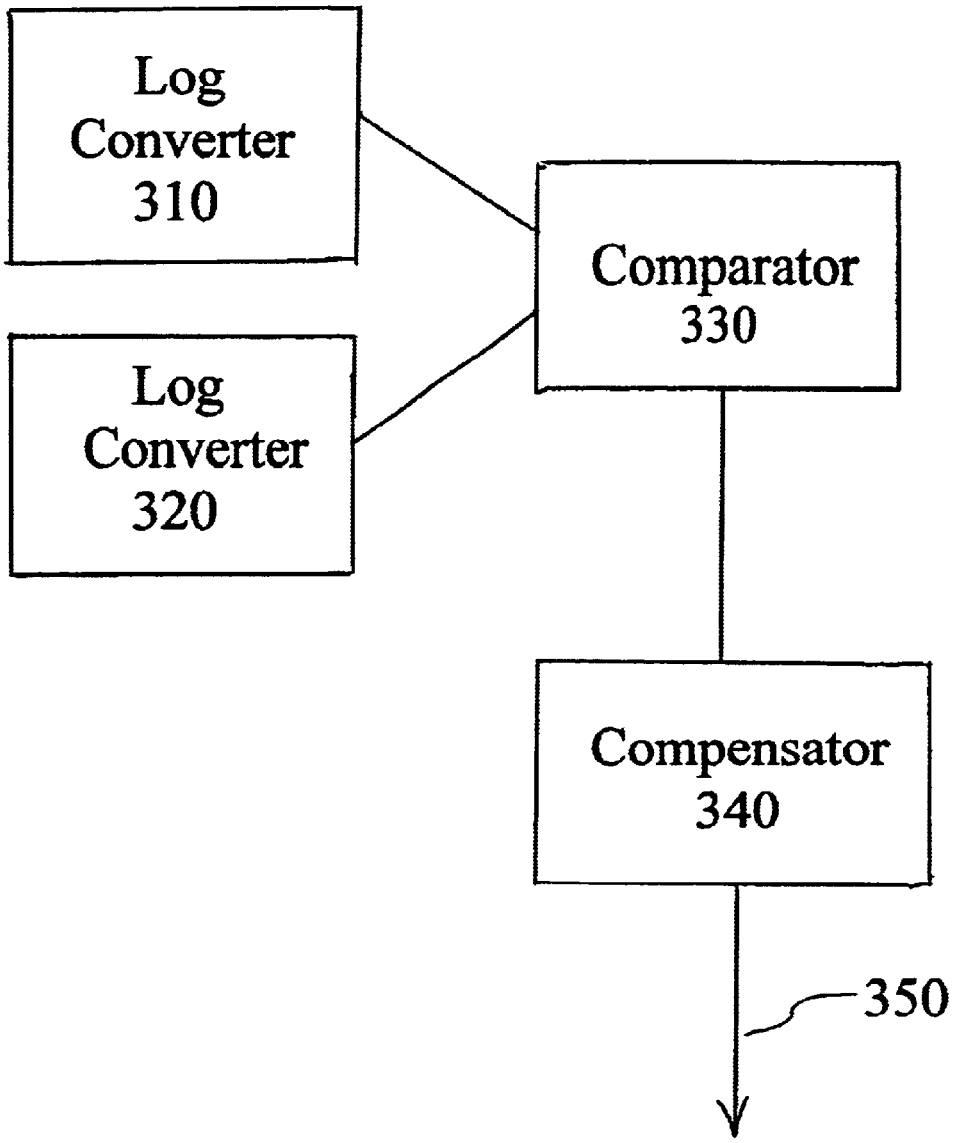
FIG. 3, is a block diagram of an embodiment of the invention that shows a circuit for an efficiency meter that compares a propeller speed signal with a boat speed signal and outputs a ratio signal indicative of negative slip, near zero slip and positive slip.

In the most preferred embodiments of this invention the propeller speed and boat speed signals are generated continuously (or the propeller speed is inferred from motor voltage) and compared with each other. A comparison circuit easily can be designed by a skilled electronics craftsman and the block diagrams shown in FIGS. 2 and 3 are representative in this regard. In preferred embodiments a "relative slip" signal is generated by the electrical comparison of propeller speed with boat speed. In most preferred embodiments the relative slip signal is a ratio of the relative propeller and relative boat speed signals as shown in FIG. 2. A ratio is preferred because it is less sensitive to boat speed. If a raw difference signal were generated by a difference comparison, the absolute magnitude of the signal (in most circumstances) should increase at higher boat speeds. The block diagram of FIG. 3 shows a compromise wherein an absolute difference signal (speed signal minus propeller rpm signal or propeller rpm signal minus speed signal) is converted to a log form to prevent excessive swings in detected output as the boat reaches higher speed and greater absolute differences. A ratio comparison, on the other hand, provides a relative "apparent slip" measurement that more accurately follows the desired parameter. In preferred embodiments the apparent slip measurement is further modified to compensate for low versus high boat speed as mentioned above. FIG. 3 shows optional compensation after the difference amplifier.

In a particularly desirable robust embodiment that has no moving parts and is very strong and inexpensive, motor voltage is used to infer propeller speed and a piezoelectric device is used to generate a boat speed signal. In an embodiment the piezoelectric device means for obtaining the boat speed is mounted on the forward hull just behind a laminar flow breaking protrusion that creates eddy currents in the water that flows past the hull. The faster the boat movement, the stronger the eddy currents, which are detected as vibrations by the piezoelectric sensor. A skilled artisan can deduce suitable surface etchings, marks and the like that create turbulent down stream flow under a wide range of water speeds and which are suitable for this embodiment of the invention. In another embodiment two electrodes are used that have a measured resistance between them. As the boat pushes through the water and water rushed between the electrodes, the electrical resistance between the electrodes increases, which is a measure of boat speed. This latter embodiment also is desirable as it allows boat speed measurement with no moving parts via means of electrode measurements.

Determining an Optimum Speed-Slip Relationship

Figure 4:
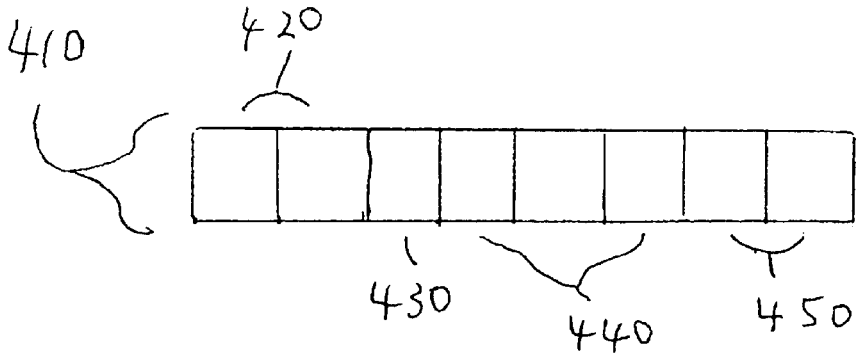
FIG. 4 shows representative optical readout displays useful for embodiments of the invention.
Figure 4:
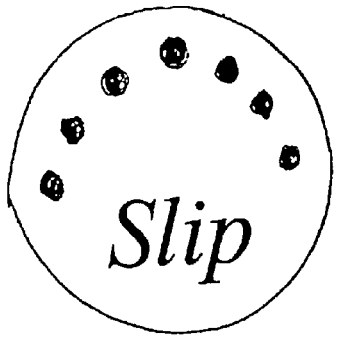
Figure 4:
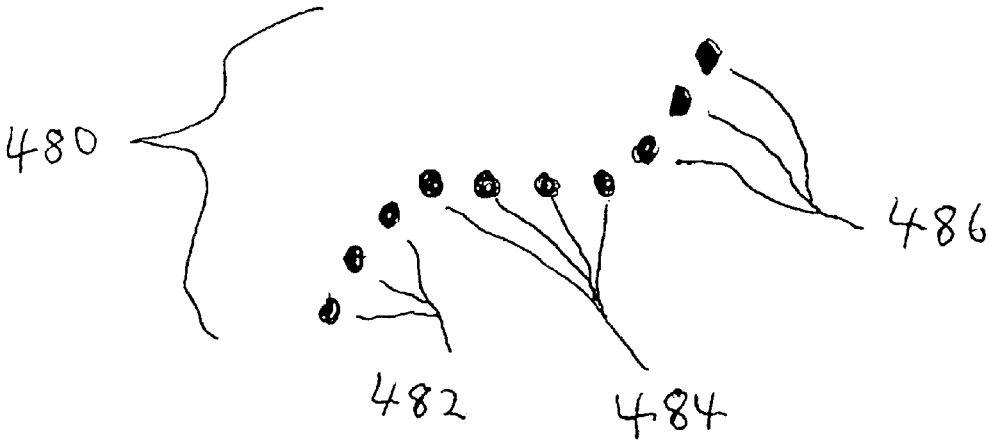
Figure 5:
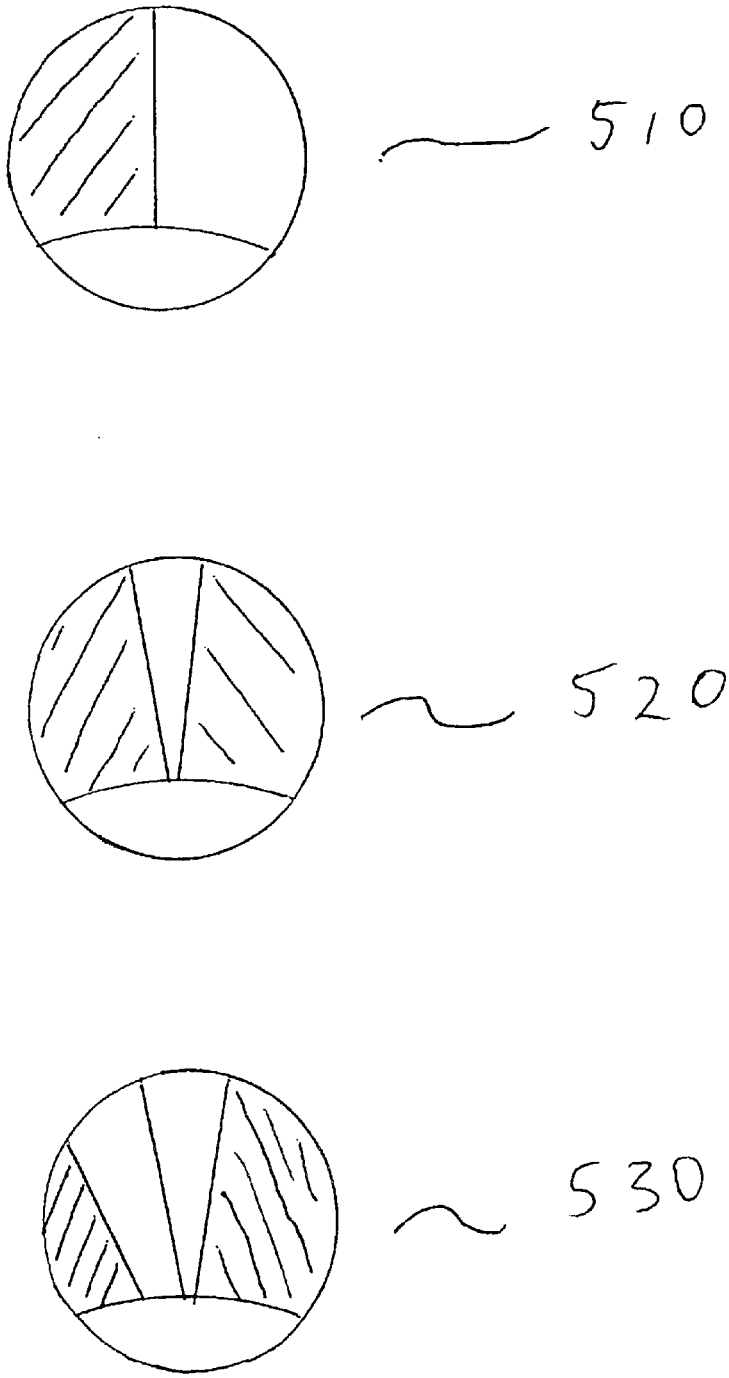
FIG. 5 shows three representative analog meter faces useful for embodiments of the invention. Each quadrant of each meter face is a different color.

Some embodiments of the invention inform the boat operator of the propeller slip condition in real time. Preferably, the slip is expressed on an analog scale using a meter display output as shown in FIG. 5. The three meters shown on this page contain increasing colored background sections. Meter 510 has two sections. Meter 520 has three sections, with the middle one having a yellow color. Meter 530 has four sections. The two middle sections are shown in clear and the two outer ones are shaded. The needle is not shown in each case and preferably simple writing is present on the background to denote quality of slip. A wide range of user friendly devices using lights can be used. See FIG. 4, which shows bar LEDs 410, LEDs 460 arranged in a semi circle and LED's 480 arranged in a staircase. The bar LED's in 4*a* are of differing colors that impart slip meaning to the user. LED's 420 are blue, meaning deceleration, LED 430 is yellow, meaning neutral propulsion, LEDs 440 are green, meaning healthy propulsion and LEDs 450 are red, meaning inefficient propulsion. The staircase LEDs 480 of FIG. 4*c* likewise are colored, with LEDs 482 being yellow, LEDs 484 being green and LEDs 486 being red. In other desirable embodiments a light is added to a panel meter such as a speedometer that indicates cavitation. In another embodiment a red, yellow and green light are added to another gauge to indicate poor, marginal and acceptable slip respectively. In other embodiments the electronic slip signal is compared with a stored value or range of values to determine whether or how the motor power should be adjusted. In this latter case one or more visual or audio signals alert the boat operator. Additionally, one or more circuits may automatically adjust the motor in response to the comparison with a reference signal.

In one embodiment the signal is compared with a known set of values such as those shown in FIG. 1. Such relationship is known, as for example shown in chart 5-2 and Table 5-1 from *Propeller Handbook* by David Gerr (Mc Graw-Hill, 1989). The chart and table provided in that reference show a desired slip for different speeds obtained by comparing different types of boats rather than performance for a given boat. One particular insight of the invention is that optimum slip differs in a reproducible manner, not just between different boat types, such as a tugboat versus a speed boat, but in particular between speeds for a single boat and propeller combination. The inventors discovered, upon exploring this insight, that tight monitoring and control for a given slip range yields rich benefits in boat and battery performance.

In one embodiment of the invention an acceptable slip for a given speed is determined by values shown in FIG. 1. In practice the values taken from Figure preferably represent a mean within a range. For example optimum speed-slip range may be approximately (i.e. exactly equal to or plus/minus an additional 25% deviation of) the plotted value in this figure plus or minus 10%, more preferably plus or minus 20%. In another embodiment the optimum range for efficient acceleration will be within the plotted value and 10%, preferably 20% and more preferably 30% above the plotted value. By way of example, an optimum speed slip range for a 5 knot vessel may be 0.55 plus or minus 0.055, plus or minus 0.11, or plus or minus 0.165. For the wider range, that means a range between 0.385 and 0.715. An efficient acceleration range might be from 0.55 to 0.605, 0.55 to 0.66 and 0.55 to 0.715 slip respectively. These figures provide general guidance. In practice a manufacturer, or in some cases the boat operator is expected to determine a most suitable range for a given boat and propeller combination.

A look up table similarly can be used as a reference to detect the excessive slip condition known as cavitation. A cavitation at low speeds might for example be determined when the boat propeller is detected as having twice the optimum slip, three times the optimum slip or even higher values. In one embodiment cavitation may be detected as any slip exceeding a certain value regardless of speed. Using the guidance provided in this specification a skilled artisan can determine suitable values for both optimum speed-slip and to signal excessive slip indicating cavitation or other excessive slip conditions.

In more preferred embodiments an optimum speed-slip relationship is determined by a calibration trial with a given boat and propeller combination. In one such embodiment, the manufacturer sets one or more reference standard curves or look-up tables (preferably as stored information in memory locations, as one or more algorithms or as electrical parameters of a circuit). The boat operator prepares a fine adjustment for a particular propeller (and/or boat loading configuration) by making at least one, and preferably at least two constant speed measurements and adjusting the stored curves or tables. For example, a computer that controls the electrical boat motor may have three stored slip curves, each curve comprising a table of boat speed values and associated table of propeller rpm values. The user would, particularly after installing a new propeller, run the boat at a constant low reference speed such as 3 knots. The computer would check and record the propeller rpm rate and (optionally motor power) upon detecting the constant speed and constant rpm relationship. The computer would use this value to select one of the three stored tables or to adjust one or the tables. More preferably a large number of tables would be used and a second speed check would be carried out.

In another embodiment the computer automatically carries out the entire calibration procedure to determine optimum speed-slip relationships (and overslip conditions). In this more preferred case, the user takes the boat out into a clear (non-crowded) area of waterway and presses a "calibration" button, which starts a calibration sequence. The calibration sequence is carried out by any of a number of ways wherein at least one constant speed or boat power is set or detected by the boat electronics, and then one or more of the other parameters are measured. The result can be compared to stored information to adjust a previous stored speed-slip relationship. More preferably, the boat would check parameters at two or more different constant speeds (or motor powers) and store the results. For example the boat could go a constant 3 mph for a minimum of 5 seconds (to establish a constant condition for 3 mph) and then record relative or absolute propeller rpm. The boat then moves at a constant 5 mph speed for at least 5 seconds, and measures relative or absolute propeller rpm. This determination of boat speed vs propeller speed would be carried out at different boat speeds to generate a more accurate real time speed-slip relationship. In yet another embodiment, the boat computer carries out calibration by comparing slip at multiple motor powers during acceleration, and does not pause at any particular speed.

In carrying out an automated calibration of the speed-slip relationship according to a preferred embodiment, it is easiest to set a constant motor power for each point. Of course, instead of setting a constant motor power a constant boat speed, or constant propeller speed can be set and another parameter(s) detected. Other conditions, such as boat loading will affect the relationship. If a boat becomes more heavily loaded then a greater slip will be required at a given speed to maintain that speed. The further factor of boat loading could be input into the computer (or added to a circuit by adjusting, for example a potentiometer) to adjust for this factor.

The signals from the propeller rpm indicater and the boat speed indicator may be developed by a computer or more powerful adjustable circuit. Most preferred in this case is a look up table of values associating boat speeds for different propeller rpm rates at constant speed conditions that could stored in a computer memory. For purposes of convenience such values herein are termed "steady state conditions." Once the values are determined, a user can set boat electric motor rpms to a given value and expect the boat to reach the speed associated with that value. If the instantaneous boat speed is greater than that value then the boat will decelerate. If the boat speed were lower than a set value then the boat will accelerate.

The boat speed versus propeller rpm information can be stored in a wide variety of forms such as including a look up table in computer memory and the setting of one or more electrical characteristics of an electrical circuit. By way of example as shown in FIG. 2 a boat speed indicator output 210 may be converted into a first voltage that varies with boat speed and is sent to D-A converter 220. A propeller speed sensor 230 (preferably a hall effect sensor attached to a propeller shaft) generates a second voltage that is sent to D-A converter 240. Each D-A converter feeds into microprocessor 250 that compares and ratios the two signals and compensates for a greater desired slip at low boat speed according to a relationship such as exemplified in FIG. 1. Microprocessor 250 outputs a signal that is converted into an analog signal by D-A converter 260. In a related embodiment (FIG. 3) no microprocessor is used and signals are converted into log form by log converters 310 and 320 and then ratioed by subtracting one from the other by comparator 330, to generate an analog signal that may be further compensated for boat speed by further circuitry 340 that outputs an analog signal 350 for use in a meter or by other circuitry such as a motor control circuit. In practice it is desired to include one or more adjustable potentiometers to set conditions for calibrating a given standard reading for a given propeller.

Compare Measured Slip with Stored Values for Motor Control

A measured relative (or absolute) slip value preferably is compared with a stored or calculated value to determine whether, for a given boat speed, the propeller is slipping too much, indicating poor acceleration efficiency or cavitation, or is slipping too little, indicating cavitation. The comparison also can indicate a change in boat loading. For example, an increased weight load will cause a higher propeller rpm and higher engine current for a given boat speed and can be detected on this basis. The condition of forgetting to pull up the anchor or propeller damage can be detected by excessive propeller speed and excessive motor current for a given boat speed. (This latter condition is distinguishable from cavitation by the combination of high motor current with low boat speed.) In embodiments of the invention a warning device is used to indicate such conditions. For example, a red warning light could energize, a chime may sound, or a gauge needle could indicate to the boat operator one or more of these conditions that adversely affect boat efficiency. In a particularly desirable embodiment the electric power to the motor is monitored in place of the rpm monitor. This embodiment is made possible in electric boats because their motor characteristics are more constant compared to fossil fueled internal combustion motor driven boats.

Most preferably the electric relative slip signal is compared with a reference value. The comparison results induce an electronic adjustment of motor power to compensate for an undesirable condition. Several adjustments are possible and desirable.

In one embodiment low speed (at least 25% lower than displacement hull speed) acceleration is optimized or adjusted in real time by decreasing or increasing motor power as appropriate to bring the slip factor into an optimum range for good efficiency. By way of example, a boat speed is determined and an optimum slip determined from a look up table that approximates the plotted curve of FIG. 1. Optimum acceleration in this example is within the plotted value and that same value times 1.3. If the measured slip is below the plotted value then the motor power is increased to bring the slip within this range. If the measured slip is above the plotted value then the motor power is decreased to bring the slip within this range.

In another embodiment acceleration for high speed (above displacement speed) is controlled in a similar manner using stored optimized slip ranges (for each boat speed) that give good efficiency during acceleration. In yet another embodiment the boat operator sets a desired speed, either in mph, knots, or a subjective cruising speed, using a control such as a push button, keyboard or knob, and the steady state slip associated with that desired speed is set automatically.

In yet another embodiment suitable for all types of boats, a device as described herein monitors for unusual loading of a propeller at low speed and outputs a response such as a buzzer when detecting an anomaly such as anchor down when trying to move away, or propeller caught in weeds, or propeller up. A skilled artisan readily will appreciate how to set a device accordingly. For example, when an anchor is still down or the propeller is caught in rope or weeds, a boat speed signal will indicate low speed, but the propeller signal and or motor signal (which could be an electronic parameter of the motor such as voltage, current or power, if an electric motor is used) indicates high resistance. For example the propeller may show high cavitation or high loading, the motor may show high loading with little boat speed and little or no acceleration. Use of a simple piezo electric detector (which tend to be less accurate during use) are particularly useful for the less accurate measurements needed in these situations and can be used for very low cost detection of boat movement. Combined with an electric motor, such systems can be very low cost as the motor electric parameters may be monitored to determine loading, rpm and the like, which are compared to determine an anomalous condition.

Having reviewed how to measure slip, how to determine a desired slip, how to make a comparison of measured slip with desired slip, to notify a boat operator and/or automatically control a boat for greater performance, several examples are presented next to illustrate several embodiments of the invention. These examples are representative and are not intended to limit the scope of the appended claims in any way.

EXAMPLES

Example 1

This example shows the generation of boat speed and propeller speed signals, and use of those signals to generate a ratio slip signal. An analog propeller speed signal is obtained by a hall effect sensor purchased from Westberg Mfg. Inc. of Sonoma, Calif. wired to a LM2917 chip. An analog boat speed signal is obtained by a hall-effect paddle wheel speed sensor attached to the trailing edge of a skis from a Maruta watercraft manufactured by ElectroCruise Boats of Homosassa Springs, Fla. The two analog signals are adjusted to provide equal ranges for each by setting amplification and zero level as needed. The adjusted signals are then converted to log form using operational amplifiers as log amplifiers with transistor junctions in their feedback loops. The log outputs are fed into a difference amplifier circuit, which subtracts the boat speed log signal from the propeller log signal to generate the ratio slip signal. The ratio signal represents both negative apparent slip (when the propeller speed is less than boat speed) and positive apparent slip (when the propeller speed is greater than boat speed).

Example 2

This example shows the generation of a positive slip indicator signal. Two adjusted analog signals are formed as described in Example 1. The boat speed signal is subtracted from the propeller speed signal by a difference amplifier and this difference is used as an absolute slip signal for an analog slip meter. In a second experiment the difference signal is fed into a log amplifier to decrease the dynamic range of the signal to allow more convenient use of an analog indicating device.

Example 3

This example shows generation of a cavitation signal. The signal output from example 1 is fed into a comparator and a reference signal corresponding to a high slip value equivalent to a slip of 100% is fed into the comparator. The comparator output is used to signal a chime. When the signal output of example 1 exceeds the reference signal the comparator turns on the chime, alerting the watercraft operator of excessive slip condition. In a separate experiment the comparator output is further processed to indicate whether the high slip condition occurs during low watercraft speed or at cruising speed. In this latter experiment a boat speed signal is fed to a threshold level detector that outputs a signal when the boat speed achieves half maximum speed. That signal is used to select a second piezo electric buzzer that signals when high (above 100%) slip occurs at higher speed condition.

Example 4

This example shows how the signal of example 1 may be used in different display formats. The circuitry of example 1 is adjusted to provide a continuous output signal of the same polarity across the entire range of watercraft and propeller speeds. The signal is modified by differential amplification to provide a 2.5 volt signal when the slip is 0 (propeller has no apparent positive or negative slip) and to provide a 5 volt signal under extreme positive slip conditions. The modified signal then is fed into a 5 volt full scale analog meter having a display surface as shown in FIG. 7.

Example 5

This example shows the instantaneous control of motor power by a slip signal produced in example 1. Circuitry as described in example 2 is constructed and adjusted to generates a logarithmic signal output proportionate to excessive slip. The output signal controls a pulse width modulation control for the electric motor that drives the propeller. When the user turns the motor on too high by adjusting a potentiometer, thus creating excessive slip, the output signal becomes a larger voltage that is impressed upon the potentiometer in an opposite polarity, countering the control voltage and decreasing the power to the motor.

Other combinations of the inventive features described above, of course easily can be determined by a skilled artisan after having read this specification, and are included in the spirit and scope of the claimed invention. References cited above are specifically incorporated in their entireties by reference and represent art known to the skilled artisan U.S. patent application Ser. No. 60/296,754 filed Jun. 11, 2001 and entitled "Monitoring and control of electric watercraft propulsion efficiency" is incorporated by reference in its entirety.

I claim:

1. A signaling system for continuously reporting electric boat propeller efficiency, comprising:

(a) a transducer that generates an electrical signal proportional to boat speed;

(b) a circuit that accepts the electrical signal proportional to boat speed and compares that signal with the voltage applied to an electric motor to output a signal; and (c) a signal display that receives the output signal and presents at least a visual or auditory signal indicating propeller efficiency, wherein a greater acceptable slip at lower speed is factored into the comparison by the circuit of (b) or is accommodated by the display system to indicate efficiency.

2. A signaling system as described in claim 1, further comprising a cavitation alert signal that indicates when excessive slip occurs.

3. A signaling system as described in claim 1, wherein the transducer lacks moving parts and is selected from the group consisting of a piezoelectric transducer, a GPS receiver and a conductive electrode measurement system.

4. A signaling system as described in claim 1, further comprising an electrical connection to a controller of the motor suitable for decreasing motor power in high slip conditions.

5. A signaling system as described in claim 1, wherein the signal display is selected from the group consisting of an analog meter with a display surface having at least two colored areas denoting acceptable efficiency and less optimum efficiency; an analog meter with a display surface having green, yellow and red lights or colored areas that respectively indicate acceptable, less acceptable and least acceptable efficiency, respectively; a display surface having multiple light emiting diodes denoting at least an acceptable efficiency and a less acceptable efficiency; a buzzer that sounds when efficiency drops below a set threshold value; a piezo sounding device that emits sound when efficiency drops below a set threshold value; and a chime that indicates when efficiency drops below a set threshold value.

6. A visual display for continuously indicating motor driven boat propeller efficiency comprising:

(a) a first electrical signal proportional to boat speed;

(b) a second electrical signal proportional to propeller speed;

(c) a circuit that accepts the first electrical signal proportional to boat speed and the second electrical signal proportional to propeller speed and compares the two signals to generate a slip measurement that is output; and (d) a signal display that accepts the output measurement selected from the group consisting of an analog meter with a display surface having at least two colored areas denoting acceptable efficiency and less optimum efficiency; an analog meter with a display surface having green, yellow and red lights or colored areas that respectively indicate acceptable, less acceptable and least acceptable efficiency, an analog meter having a display surface with at least 3 regions located from left to right as indicating negative slip (deceleration), acceptable slip and excessive slip (or cavitation) respectively; a display surface having multiple light emitting diodes denoting at least an acceptable efficiency and a less acceptable efficiency; and a liquid crystal display, wherein a greater acceptable slip at lower speed is factored into the comparison by the circuit of (c) or is accommodated by the display to indicate acceptable slip.

7. A visual display system as described in claim 6, wherein the first electrical signal proportional to boat speed is selected from the group consisting of: an electrical signal proportionate to motor current; an electrical signal proportionate to motor power; and an electrical signal generated by a boat speed transducer.

8. A visual display system as described in claim 6, wherein the circuit compensates for a lower desirable slip at higher boat speeds by electrically subtracting a signal corresponding to boat speed from a signal corresponding to a derived slip measurement before outputting the compensated result.

9. A visual display system as described in claim 6, wherein the second electrical signal is motor voltage.

10. A visual display of boat propeller efficiency as described in claim 6, wherein the circuit of (c) converts an analog signal of (a) to logarithmic form, converts an analog signal of (b) to logarithmic form and then compares the two logarithmic signals to obtain an output signal corresponding to propeller efficiency.

11. A visual display of boat propeller efficiency as described in claim 6, wherein the circuit of (c) comprises a computer.

12. A cavitation indicator for a motor driven watercraft, the indicator detecting low speed acceleration cavitation separate from cavitation occurring at another speed, comprising:

(a) a transducer or motor voltage input for generating an electrical signal proportional to propeller rpm;

(b) a reference electric signal that is proportional to at least motor power, motor current or boat speed;

(c) a comparator that receives signals from (a) and (b) wherein the comparator uses the signals from (a) and (b) to separately detect low speed acceleration cavitation, no cavitation and high speed cavitation conditions; and (d) a signaling device.

13. A cavitation indicator as described in claim 12, wherein the signaling device is selected from the group consisting of an analog panel meter, a bell, a piezo transducer, a light emitting diode, light emitting diodes, liquid crystal display and a chime.

14. A cavitation indicator as described in claim 12, wherein the signaling device further is used to control the watercraft motor, to alleviate cavitation upon detection of the cavitation by decreasing motor speed.

15. A cavitation indicator as described in claim 12, further comprising a piezoelectric transducer in contact with water that generates the reference electrical signal of (b) proportional to boat speed.

16. A cavitation indicator for a motor driven watercraft, the indicator capable of detecting low speed acceleration cavitation separate from cavitation occurring at another speed, comprising:

(a) a transducer or motor voltage input for generating an electrical signal proportional to propeller rpm;

(b) a reference electric signal that is proportional to at least motor power, or motor current;

(c) a comparator that receives signals from (a) and (b) wherein the comparator uses the signals from (a) and (b) to separately detect low speed acceleration cavitation, no cavitation and high speed cavitation conditions; and (d) a signaling device.

17. A cavitation indicator as described in claim 16, wherein the signaling device further is used to control the watercraft motor, to alleviate cavitation upon detection of the cavitation by decreasing motor speed.

18. A cavitation indicator for an electric motor driven watercraft, the indicator capable of detecting low speed acceleration cavitation separate from cavitation occurring at another speed comprising:

(a) a transducer or motor voltage input (or generating an electrical signal proportional to propeller rpm;

(b) a reference electric signal that is proportional to at least motor power, motor current or boat speed;

(c) a comparator that receives signals from (a) and (b) wherein the comparator uses the signals from (a) and (b) to separately detect low speed acceleration cavitation, no cavitation and high speed cavitation conditions; and (d) a signaling device.

19. A cavitation indicator as described in claim 18, wherein the signaling device is selected from the group consisting of an analog panel meter, a bell, a piezo transducer, a light emitting diode, light emitting diodes, a liquid crystal display and a chime.

20. A cavitation indicator as described in claim 18, wherein the signaling device further is used to control the watercraft motor, to alleviate cavitation upon detection of the cavitation by decreasing motor speed.

21. A cavitation indicator as described in claim 18, further comprising a piezoelectric transducer in contact with water that generates the reference electrical signal of (b) proportional to boat speed.

22. A signaling system for continuously reporting motor boat propeller efficiency, comprising:

(a) a transducer that generates a that electrical signal proportional to boat speed;

(b) a second electrical signal proportional to propeller speed;

(c) a circuit that accepts the first electrical signal proportional to boat speed and the second electrical signal proportional to propeller speed and compares the two signals to output a signal; and (d) a signal display that receives the output signal end presents at least a visual or auditory signal indicating propeller efficiency, wherein a greater acceptable slip at lower speed is factored into the comparison by the circuit of (c) or is accommodated by the display system to indicate efficiency.

23. A signaling system as described in claim 22, further comprising a cavitation alert signal that indicates when excessive slip occurs.

24. A signaling system as described in claim 22, wherein the transducer lacks moving parts and is selected from the group consisting of a piezoelectric transducer, a GPS receiver and a conductive electrode measurement system.

25. A signaling system as described in claim 22, further comprising an electrical connection to a controller of an electric motor suitable for decreasing motor power in high slip conditions.

26. A signaling system as described in claim 22, wherein the signal display is selected from the group consisting of an analog meter with a display surface having at least two colored areas denoting acceptable efficiency and less optimum efficiency; an analog meter with a display surface having green, yellow and red lights or colored areas that respectively indicate acceptable, less acceptable and least acceptable efficiency, respectively; a display surface having multiple light emiting diodes denoting at least an acceptable efficiency and a less acceptable efficiency; a buzzer that sounds when efficiency drops below a set threshold value; a piezo sounding device that emits sound when efficiency drops below a set threshold value.

* * * * *